United States Patent [19]

Honolke et al.

[11] 4,440,544

[45] Apr. 3, 1984

[54] PROCESS FOR THE CONVERSION OF GROUND HYDROUS LIGNITE INTO A PUMPABLE DEHYDRATED SUSPENSION OF FINE-GROUND LIGNITE AND OIL

[75] Inventors: Friedrich Honolke; Adrian Brandl; Eduard Schibilla; Gerhard Hohne, all of Dortmund, Fed. Rep. of Germany

[73] Assignee: Uhde GmbH, Dortmund, Fed. Rep. of Germany

[21] Appl. No.: 380,998

[22] Filed: May 21, 1982

[30] Foreign Application Priority Data

May 23, 1981 [DE] Fed. Rep. of Germany ..... 3120602

[51] Int. Cl.[3] ..... C10L 1/32

[52] U.S. Cl. ..... 44/51; 44/1 G; 44/10 D

[58] Field of Search ..... 44/51, 1 G, 10 D

[56] References Cited

U.S. PATENT DOCUMENTS

| | | | |
|---|---|---|---|
| 1,390,228 | 9/1921 | Bates | 44/51 |
| 1,390,232 | 9/1921 | Bates | 44/51 |
| 1,939,587 | 12/1933 | Adam et al. | 44/51 |
| 2,162,200 | 6/1939 | Kiesskalt et al. | 44/51 |
| 4,239,496 | 12/1980 | Cochran | 44/51 |
| 4,265,637 | 5/1981 | Anderson | 44/51 |
| 4,309,192 | 1/1982 | Kubo et al. | 44/51 |

*Primary Examiner*—Charles F. Warren
*Assistant Examiner*—Y. Harris Smith
*Attorney, Agent, or Firm*—Fraser, Barker, Purdue & Clemens

[57] ABSTRACT

A method for producing a pumpable suspension in oil of dehydrated, finely-ground lignite is disclosed. The method involves mixing hydrous, ground lignite with an oil and gasoline, grinding the lignite in the mixer so that substantially all the particles are finer than 2 mm, heating and pressurizing this suspension which results to a temperature in the range of 190° to 240° C. and a pressure in the range of 30 to 80 bar and maintaining the suspension at temperature and pressure conditions within the indicated ranges for at least five minutes, separating the suspension into a slurry of partially dehydrated lignite and oil and a liquid composed principally of water, gasoline and oil, separating water from the foregoing liquid and mixing the oil and gasoline which remain with the slurry of partially dehydrated lignite and oil to produce a suspension of partially dehydrated lignite, reducing the pressure of the suspension of partially dehydrated lignite to one in the range of 1 to 18 bar while maintaining the temperature thereof at one in the range of 190° to 240° C. and separating water and the diluent from the foregoing suspension, leaving a dehydrated lignite suspension in oil.

13 Claims, 2 Drawing Figures

PROCESS FOR THE CONVERSION OF GROUND HYDROUS LIGNITE INTO A PUMPABLE DEHYDRATED SUSPENSION OF FINE-GROUND LIGNITE AND OIL

BACKGROUND OF THE INVENTION

The invention relates to a process for the conversion of ground hydrous lignite into a pumpable dehydrated suspension of fine-ground lignite and oil. Suspensions of this kind are used for subsequent hydrogenation at temperatures of 300° to 500° C. and pressures of 100 to 700 bar.

Hydrogenation of lignite is a known process which was developed and perfected for industrial application by Bergius and Pier.

The lignite is prepared for hydrogenation by grinding and drying to a water content which should be less than 5% and by mixing it with oil, thus obtaining a suspension. A higher water content would have an unfavorable effect on hydrogenation and on the pumpability of the lignite/oil suspension.

The relatively high pit humidity of the lignite, i.e. 50 to 60% water, referred to coal, requires a considerable expenditure for dehydration. In the literature hitherto published, two methods of dehydration have been described. One method consists of drying the lignite with low-pressure steam or hot flue gases and another method comprises the mixing of the lignite with oil with subsequent removal of the water by distillation as referred to in the Canadian Pat. No. 978,877. Dehydration by evaporation is very expensive as regards energy and equipment and furthermore influences the thermal efficiency of the hydrogenation process. Removal of the water by distillation, which requires very large heat exchange surfaces, is hardly feasible from the economical and industrial standpoint.

Another method, a further development, as described in DP-OS Nos. 26 53 033 and 28 31 024, consists of mixing the pit-wet lignite with oil and dehydrating the mixture at high temperatures and high pressures. The disadvantage of these methods resides in the poor flowability of the hydrous lignite/oil sludge. The sludge transport through pipes and heat exchangers presents considerable difficulties. Another disadvantage is the relatively high expenditure for the equipment which is necessary for heating the suspension to temperatures above 250° C. and for its subsequent cooling. A further disadvantage is the three-phase separation of oil/water-/oil-soaked lignite which cannot be achieved by simple sedimentation of the phases.

SUMMARY OF THE INVENTION

The object of the present invention is to eliminate the disadvantages of the processes known.

According to the present invention, this object is achieved with the aid of a process as mentioned at the outset by combining the features outlined in the characterizing part of the principal claim.

According to the characterizing parts of the subclaims, the process may expediently be varied and/or completed.

By combining the features of this invention, the disadvantages encountered in preparing the lignite for the subsequent hydrogenation process are eliminated and the necessary expenditure for energy and equipment is considerably reduced. Furthermore, the lignite can be dehydrated down to 0.5% by weight.

By adding the gasoline fraction, the viscosity of the suspension is reduced by about a power of ten so that it may easily be delivered by centrifugal pumps. The suspension is fed to a mill battery where the lignite is preferably ground to a grain size of less than 2 mm. Then the suspension is pressurized by a centrifugal pump to 30 to 80 bar and subsequently heated to 190° to 240° C. At these temperatures, the colloidal structure of the lignite is irreversibly destroyed. At the same time, the oxygenic oil causes the water to be displaced from the coal pores. Penetration of the oil into the coal pores is still promoted by the reduction of the viscosity due to the addition of the gasoline fraction so that temperatures between 190° and 240° C. are sufficient for this heat/pressure treatment.

Phase separation of the mixture consisting of the oil-bearing layer, the water, and the oil-soaked lignite is performed in two stages. In the first stage, separation of the liquid phase from the solids takes place in a hydrocyclone or decanting centrifuge. In the next stage, the oil-bearing layer consisting of oil and of the gasoline fraction is separated from the water. After remixing the oil-bearing layer with the lignite, the suspension is flashed in a stripper and the residual water is partly removed by azeotropic distillation together with the gasoline fraction. Evaporation is additionally promoted by feeding in inert gas. The condensed gasoline fraction is reused after phase separation.

BRIEF DESCRIPTION OF THE DRAWINGS

The above objects and advantages of the invention will become clearly manifest to those skilled in the art from considering the following detailed description of two embodiments of the invention in the light of the attached drawing wherein.

DETAILED DESCRIPTION OF THE PREFERRED EMBODIMENTS OF THE INVENTION

Figure 1:
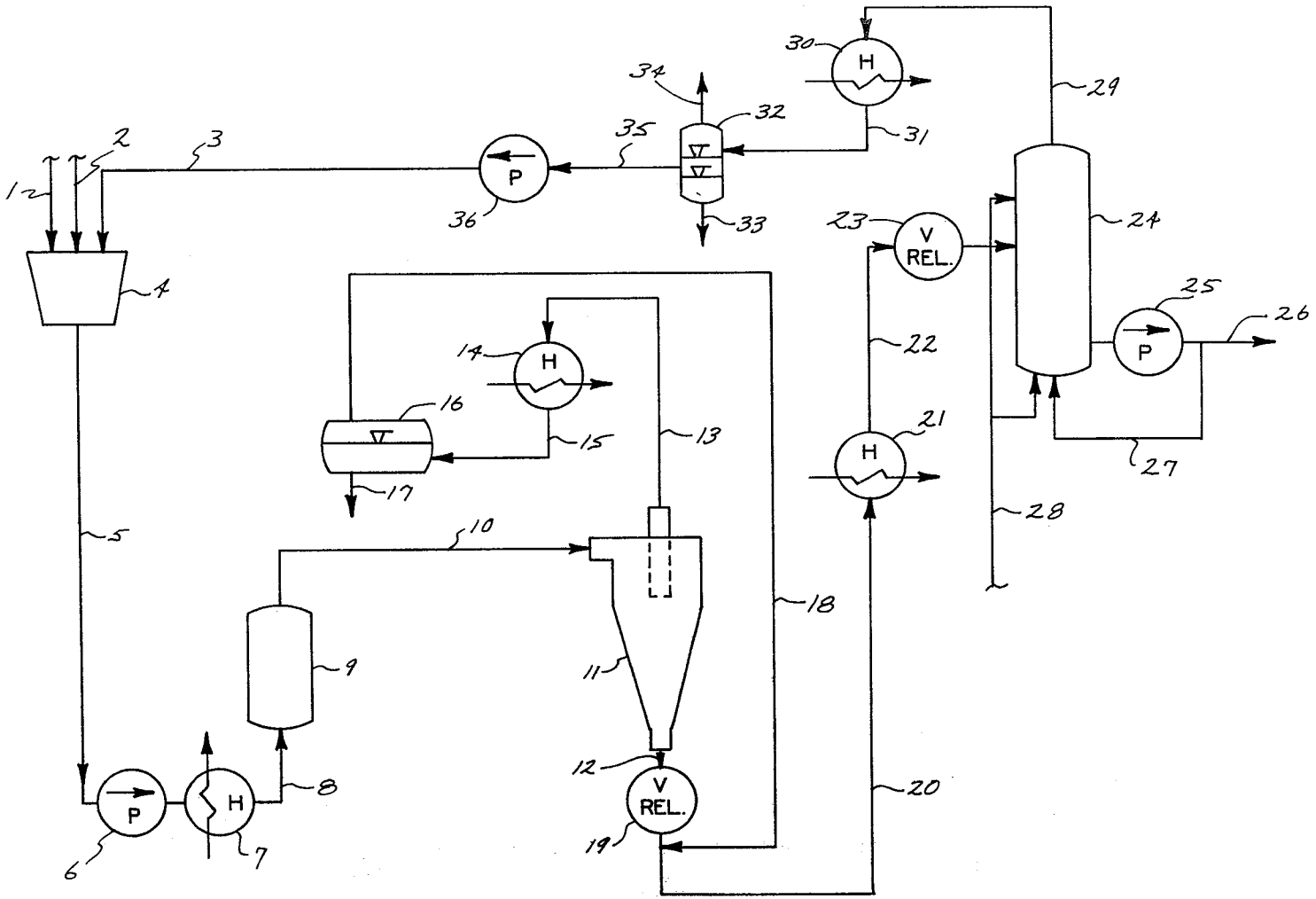
FIG. 1 is a schematic illustration of one embodiment of the invention.

In the case of the embodiment of the invention according to FIG. 1, pit-wet ground lignite is fed through line 1, oil through line 2, and a low-boiling gasoline fraction through line 3 to a mill battery in which the lignite is ground to a grain size of less than 2 mm and mixed with the oil and the gasoline fraction. Pumpability of the suspension is achieved by adding the gasoline fraction. The pumpable suspension is fed through line 5 to a pump by which the pressure of the suspension is increased to 30 to 80 bar. In heat exchanger 7 the suspension is heated to temperatures between 190° and 240° C. The heated suspension is sent through line 8 to a vessel 9 in which it remains for at least 5 minutes at a temperature between 190° and 240° C.

At such temperatures, the colloidal structure of the lignite is irreversibly destroyed. At the same time, the water is displaced from the coal pores by the oil and the low-boiling gasoline fraction.

The suspension, in which more than 60% of the pit moisture of the lignite have been displaced into the liquid phase, is conveyed tangentially through line 10 into hydrocyclone 11. The oil-soaked partially dehydrated lignite, the density of which is higher than that of the liquid phase, is separated at the cone wall and is discharged by a pressure difference of up to 4 bar through an open nozzle. Then the coal sludge is expanded in pressure letdown valve 19 to a pressure that is by 2 to 3 bar lower than the discharge pressure. The inner eddy discharging towards the overflow nozzle consists of a water/oil/gasoline mixture.

The liquid stream is sent through line 13 to heat exchanger 14 for cooling to below 160° C. The cooled stream flow through line 15 to separator 16 in which the heavy aqueous phase is separated from the light oily phase. The aqueous phase is drawn off through line 17. The oil phase consisting of an oil/gasoline mixture is added through line 18 to the partially dehydrated oil-soaked lignite. After mixing, the oil-bearing suspension is, if necessary, heated in heat exchanger 21 to a temperature between 190° and 240° C.

The suspension is depressurized by pressure letdown valve 23 to 1 to 3 bar and then fed to stripper 24. Depressurization causes the residual water of the suspension to evaporate. It is partially removed by azeotropic distillation together with the gasoline fraction. Evaporation is promoted by blowing in inert gas, such as nitrogen or carbon dioxide, through line 28. The minimum retention time of the liquid in stripper 24 is 3 minutes. Foaming during evaporation is reduced by blowing in the inert gas into stripper 24 laterally.

The overhead product of stripper 24 is sent through line 29 to condenser 30. The three phases, viz. the inert gas, the condensed gasoline fraction with a low oil content, and the condensed heavy aqueous layer are separated in stripper 32. The inert gas is removed through line 34 and the aqueous layer through line 33. The oily layer is returned via line 35, pump 36, and line 3 to mill battery 4.

The bottom product of stripper 24 consisting of a lignite/oil suspension with a water content of about 0.5% is drawn off by pump 25. Part stream 27 is recycled to avoid sedimentation of solids in the stripper. Having been pressurized and heated, the dehydrated lignite/oil suspension is used as feedstock for the hydrogenation process. The catalyst required for hydrogenation may already be added to the suspension in mill battery 4 unless it is water-soluble. In the latter case it must be admitted after the first phase separation step, in which water is separated from the lignite.

Figure 2:
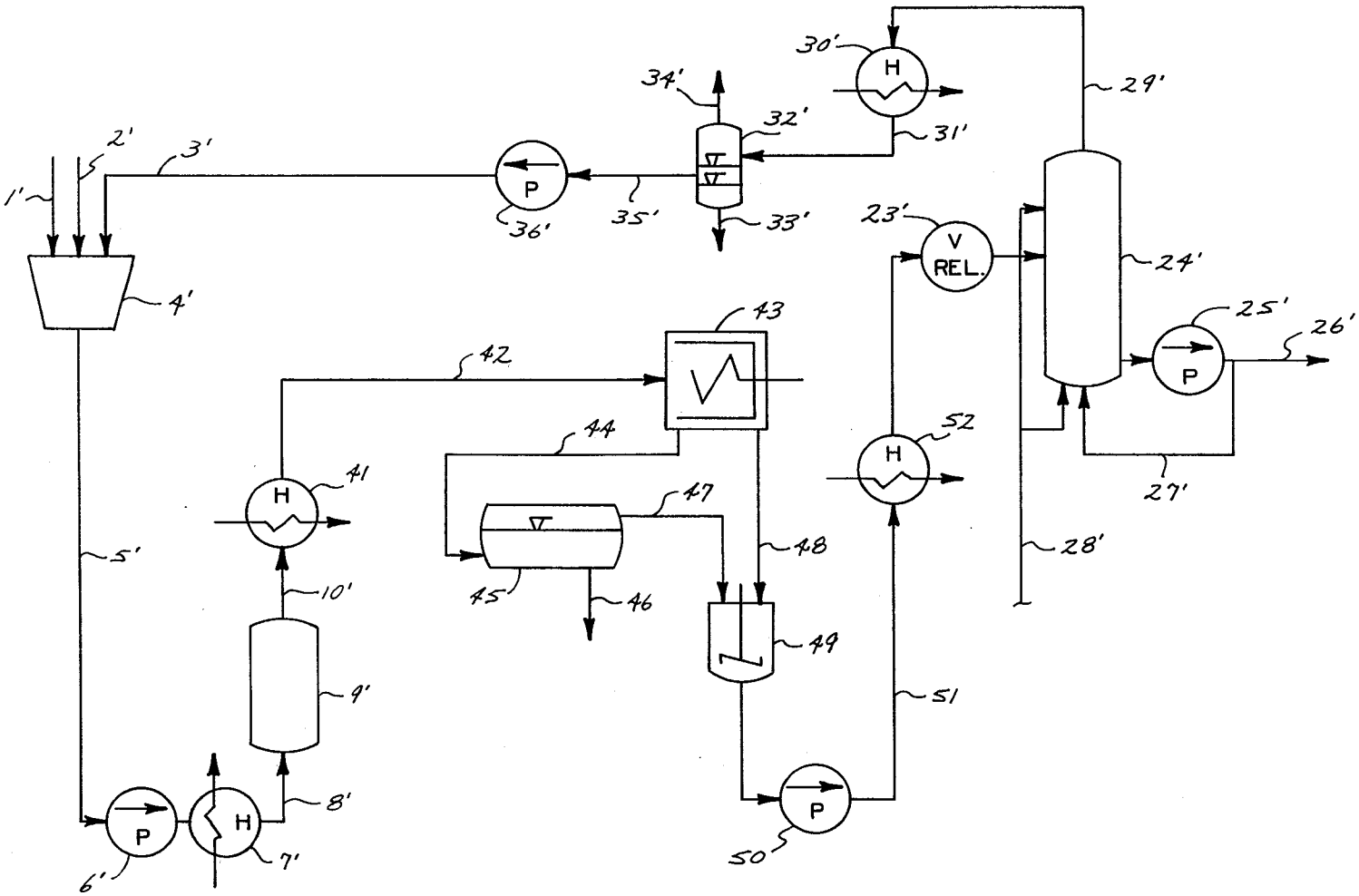
FIG. 2 is a schematic illustration of another embodiment of the invention.

In another alternative embodiment of the invention according to FIG. 2 wherein similar apparatus to that illustrated in FIG. 1 is designated by prime reference numerals, the suspension heated to 190° to 240° C. is sent from vessel 9 through line 10 to heat exchanger 41, cooled down to a temperature corresponding to a maximum vapor pressure of the suspension of 10 bar and routed through line 42 into decanting centrifuge 43. The decanted liquid is fed through line 44 to oil/water separator 45 in which a light oily phase consisting of an oil/gasoline mixture is separated from a heavy aqueous phase. The aqueous phase is withdrawn via line 46. The oily phase is sent through line 47 to mixer 49 where it is mixed with the centrifuged sludge to form a suspension consisting of lignite/oil/gasoline.

The suspension is sent by pump 50 through a line 51 and to a heat exchanger 52 where it is heated to 190° to 240° C. Subsequently, the suspension is further processed by flashing in pressure letdown valve 23 and by inert gas-sustained azeotropic distillation, as in the first alternative.

The two process alternatives described offer the possibility of reducing the water content of the lignite/oil suspension to 0.5%.

EXAMPLE 1

In an experimental installation according to FIG. 2, 500 g of pit-wet raw lignite with a water content of 54.4% by weight, an ash content of 2.8% by weight, and a grain size of less than 1 mm are mixed with 275 g of oil and 62.5 g of a gasoline fraction to form a suspension. The boiling range of the oil is 250° to 450° C. and the density 0.973 g/cm$^3$ at 20° C. The boiling range of the gasoline fraction is 110° to 140° C. and the density 0.730 g/cm$^3$ at 20° C.

The suspension is fed to an autoclave. The mixture is heated to 240° C., which temperature is maintained for 5 minutes. The heating causes the vapor pressure to rise to 42.5 bar. Then the mixture is cooled to 40° C. and, after pressure compensation, centrifuged. Thus 385.5 g of clear liquid are obtained. This liquid is separated in a decanter into a light oil phase and a heavy aqueous phase. The aqueous phase contains 199.5 g of water, i.e. 73.4% by weight of the water have been removed from the pit-wet lignite without prior evaporation.

The light oil phase is mixed in a distillation flask with the centrifuge residue to form suspension of oil/-gasoline/partially dehydrated lignite. By heating the suspension, an azeotropic mixture of water/gasoline and subsequently of water/oil with a low oil portion distills at a top temperature of 92° to 96° C. Distillation is promoted by blowing in nitrogen. Temporary foaming in the flask is reduced by blowing the nitrogen in laterally.

The distillation process is stopped when a bottom temperature of 210 C. is reached. After condensation, the overhead product is separated into a reusable gasoline fraction of low oil content and a heavy aqueous layer. The quantity of water separated amounts to 70.6 g. The water content of the lignite/oil suspension is 0.5% by weight.

EXAMPLE 2

For this test, the same raw materials are used as in example 1. 500 g of pit-wet raw lignite with a water content of 54.4% by weight, an ash content of 2.8% by weight, and a grain size of less than 2 mm are mixed with 275 g of oil and 62.5 g of a gasoline fraction.

The suspension is fed to an autoclave. The mixture is heated to 200° C., which temperature is maintained for 5 minutes. The heating causes the vapor pressure to rise to 21 bar. Then the mixture is cooled to 40° C. and subsequently centrifuged. The clear liquid obtained amounts to 361 g.

The clear liquid is separated in a decanter into a light oily phase and a heavy aqueous phase. The aqueous phase contains 182 g of water, i.e. 67% by weight of the water have been removed from the pit-wet lignite without prior evaporation.

The light oily phase is mixed in a distillation flask with the centrifuge residue to form a suspension of oil/gasoline/partially dehydrated lignite. By heating the suspension, an azeotropic mixture of water/gasoline and subsequently of water/oil with a low oil portion distills at a top temperature of 92° to 96° C. Distillation is promoted by blowing in nitrogen. Temporary foaming in the flask is reduced by blowing the nitrogen in laterally.

The distillation process is stopped when a bottom temperature of 210° C. is reached. After condensation, the overhead product is separated into a reusable gasoline fraction of low oil content and a heavy aqueous layer. The quantity of water separated amounts to 87 g. The water content of the lignite/oil suspension is 0.8% by weight.

What is claimed:

1. A method for producing a pumpable suspension in oil of dehydrated, finely-ground lignite, said method comprising the steps of:

(a) mixing hydrous, ground lignite with an oil which has a vapor pressure less than ½ bar at a temperature in the range of 190° to 240° C. and a diluent for the oil, said diluent being inert with respect to and miscible with the oil being effective to produce a solution with the oil which has a viscosity lower than that of the oil, being immiscible with water, and having a vapor pressure greater than 1 bar at a temperature in the range of 190° to 240° C.;

(b) controlling the proportions of the lignite, of the oil and of the diluent so that the mixture, when the lignite is ground so that substantially all the particles thereof are finer than 2 mm, is a pumpable suspension;

(c) grinding the lignite in the mixture so that substantially all the particles thereof are finer than 2 mm;

(d) heating the suspension to a temperature in the range of 190° to 240° C.;

(e) subjecting the suspension to a pressure in the range of 30 to 80 bar;

(f) partially dehydrating the lignite therein by maintaining the suspension at a temperature within the range of 190° to 240° C. and at a pressure in the range of 30 to 80 bar for at least 5 minutes;

(g) after the partial dehydration step, separating the suspension into a slurry of partially dehydrated lignite and oil and a liquid composed principally of water, diluent and oil;

(h) separating water from the liquid of step (g) and mixing the oil and diluent which remain with the slurry of partially dehydrated lignite and oil from step (g) to produce a suspension of partially dehydrated lignite;

(i) reducing the pressure of the suspension of partially dehydrated lignite to one in the range of 1 to 18 bar while maintaining the temperature thereof at one in the range of 190° to 240° C.; and (j) separating water and the diluent from the suspension of step (i), leaving a dehydrated lignite suspension in oil.

2. A method as claimed in claim 1 in which the temperature of the lignite suspension of step (i) is one at which the vapor pressures of water and of the diluent exceed, while that of the oil is below, the pressure of the slurry, and the separation of step (j) is accomplished by vaporization.

3. A method as claimed in claim 1 in which the separation of step (g) is accomplished in a hydrocyclone.

4. A method as claimed in claim 1 in which, after the partial dehydration of step (f) the suspension is cooled to a temperature at which its pressure is 10 bar, and the separation of step (g) is accomplished in a centrifuge.

5. A method as claimed in claims 1, 2, 3 or 4 wherein the oil is derived from non-refined coal hydrogenation or carbonization products.

6. A method as claimed in claim 5 wherein substantially all the constituents of the oil have a vapor pressure of 760 mm Hg at a temperature within the range of 250° to 500° C.

7. A method as claimed in claims 1, 2, 3 or 4 wherein the diluent is a hydrocarbon which has, or a hydrocarbon mixture substantially all of the components of which have, a vapor pressure of 760 mm Hg at a temperature within the range of 110° to 104° C.

8. A method as claimed in claim 7 wherein the diluent is gasoline.

9. A method as claimed in claim 1 wherein the hydrous, ground lignite, the oil and the diluent are mixed in such proportions that their weight rations, on the basis of dry lignite, are from 1:1:0.25 to 1:1.8:0.10.

10. A method as claimed in claim 2 wherein an inert gas is introduced into the suspension to facilitate the separation by vaporization of step (j).

11. A method as claimed in claim 10 wherein the inert gas is introduced laterally into the suspension.

12. A method as claimed in claim 10 wherein the inert gas is nitrogen or carbon dioxide.

13. A method as claimed in claim 2 in which the vaporized diluent and the vaporized water are condensed, and the former is separated from the latter and recycled to mixing step (a).

* * * * *